US006685816B1

(12) United States Patent
Brattinga et al.

(10) Patent No.: US 6,685,816 B1
(45) Date of Patent: Feb. 3, 2004

(54) PROTECTION OF A SURFACE BY PARTIALLY SUBJECTING IT TO AN ELECTROCHEMICAL TREATMENT

(75) Inventors: Sjoerd Johannes Franciscus Brattinga, Drachten (NL); Hans Kuiper, Drachten (NL); Mattheus Franciscus Langedijk, Drachten (NL); Ytsen Wielstra, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/706,666

(22) Filed: Nov. 6, 2000

(30) Foreign Application Priority Data

Nov. 4, 1999 (EP) ..... 99203642

(51) Int. Cl.[7] ..... C25D 5/02
(52) U.S. Cl. ..... 205/135; 205/118
(58) Field of Search ..... 205/118, 135

(56) References Cited

U.S. PATENT DOCUMENTS

| | | | | |
|---|---|---|---|---|
| 3,284,321 A | | 11/1966 | Fromson | 204/15 |
| 3,450,606 A | | 6/1969 | Darrow | 204/18 |
| 3,909,367 A | * | 9/1975 | Patrie et al. | 204/18 R |
| 4,066,516 A | * | 1/1978 | Sato | 204/15 |
| 4,193,797 A | * | 3/1980 | Cohen et al. | 430/258 |
| 5,631,119 A | * | 5/1997 | Shinozaki | 430/326 |

FOREIGN PATENT DOCUMENTS

| | | | |
|---|---|---|---|
| DE | 2363667 | | 6/1975 |
| JP | 57-149491 A | * | 9/1982 |
| JP | 62-278277 | | 12/1987 |
| NL | 75-000984 | * | 10/1954 |
| TW | 242131 A | * | 3/1991 |
| WO | 98/13434 | | 4/1998 |
| WO | 98/22548 | | 5/1998 |

OTHER PUBLICATIONS

* References A, B and N were cited on the International Search Report.*
** Abstract only.*

* cited by examiner

*Primary Examiner*—Edna Wong
(74) *Attorney, Agent, or Firm*—Ernestine C. Bartlett

(57) ABSTRACT

In a method of providing a surface with a protection layer having at least a first surface area (2) and a second surface area (1), which surface areas (1, 2) are distinguishable in that the surface areas (1, 2) differ from each other in at least one visual property, parts of the surface situated outside the first surface area (2) are masked with a mask layer which partially covers the surface, and the surface is subjected to an electrochemical treatment (14, 20), whereby non-masked parts of the surface are treated. As the mask layer provided on the surface is a sol-gel layer forming the protection layer in the second surface area (1), a wear-resistant surface-protection layer having visually distinguishable surface areas is provided in an efficient manner. An object which can be obtained by the proposed method is also described.

12 Claims, 1 Drawing Sheet

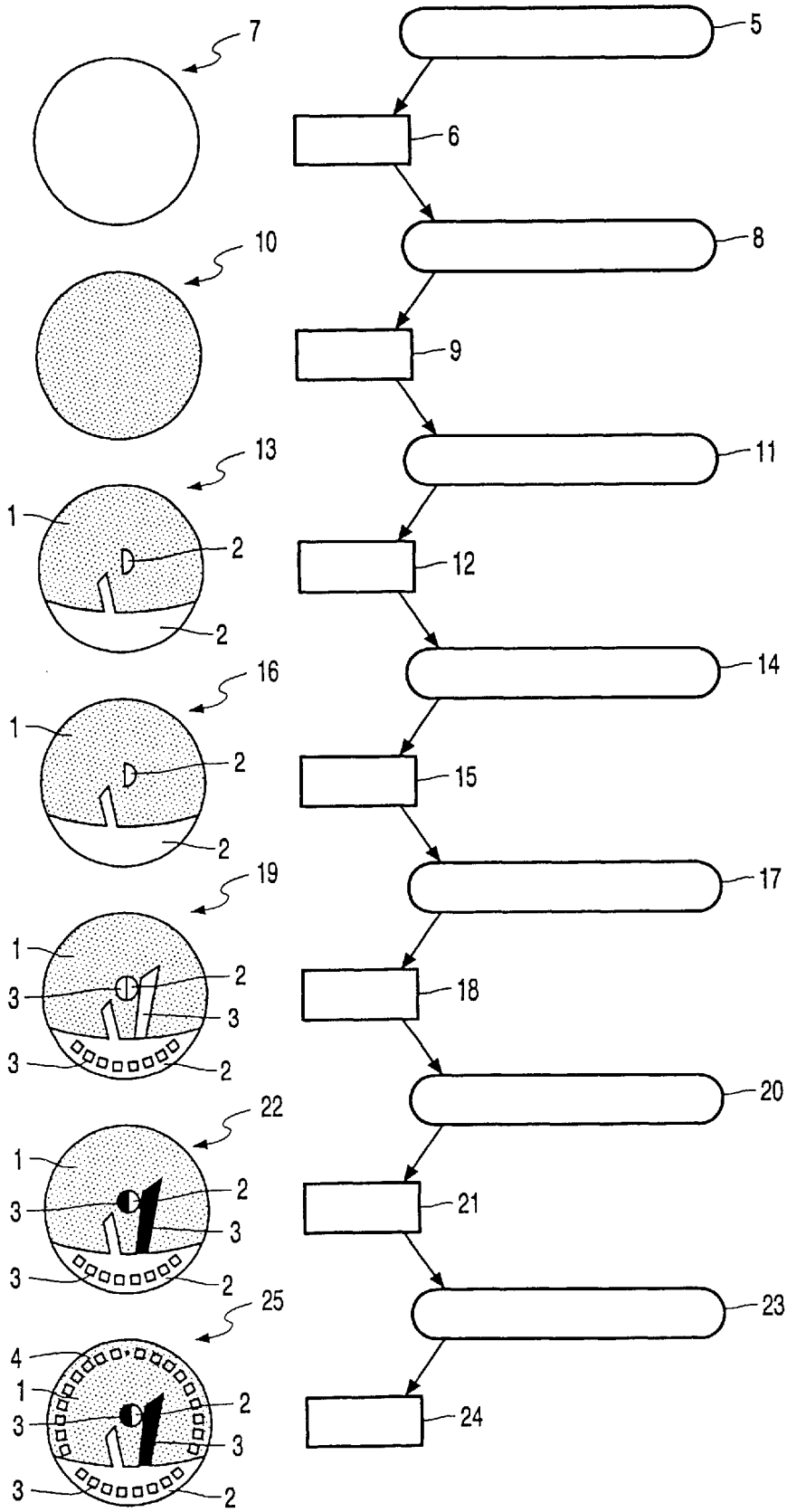
5
6
7
8
9
10
11
12
13
14
15
16
17
18
19
20
21
22
23
24
25
1
2
3
4

PROTECTION OF A SURFACE BY PARTIALLY SUBJECTING IT TO AN ELECTROCHEMICAL TREATMENT

BACKGROUND OF THE INVENTION

The invention relates to a method of forming a wear and scratch resistant protective layer on a surface of a support, where the protective layer comprises at least a first surface area and a second surface area, the surface areas are distinguishable by virtue of the fact that the surface areas differ from each other in at least one visual property, and the method further comprises:

partially masking parts of said support outside said first surface area with a mask layer which partially covers the support, and subjecting the support to an electrochemical treatment, wherein the first surface area of the protective layer is formed in non-masked parts of the support.

Such a method, and such an object, are disclosed in U.S. Pat. No. specification 3,284,321. In accordance with said patent specification, a surface is partially provided with a mask and subsequently electrochemically treated by anodizing it. Only the first, non-masked area of the surface is provided with an anodized layer. As described in said patent specification, the anodized area of the surface is subsequently sealed, so that it is no longer porous. Next, the mask is removed, for example by means of a solvent, and the surface is re-anodized. As the surface area anodized during the first anodizing treatment is sealed, the second anodizing treatment has little or no effect on the surface area anodized during the first anodizing treatment.

In this manner, a surface is obtained comprising two or more optically different areas, which surface is wear and scratch-resistant, and protected against chemical attack, said surface additionally being visually attractive. Also the anodized layer formed during the second anodizing treatment is preferably sealed.

As a result of said properties, electrochemically treated surfaces, such as anodized and chrome-plated surfaces can very suitably be used as the outer layer of parts of utensils which are subjected to intensive contact with users, such as housing parts of, in particular shaver heads, of shavers (in this respect, also the resistance to solvents and compositions for personal care such as shaving lotions, shaving soap and the like is important), control buttons, gear lever knobs, handles, clasps of bags and suitcases, and stationery.

However, the removal of the mask and the re-anodizing treatment are laborious. In addition, the use of solvents to remove masks requires special measures to preclude emissions of volatile solvents into the environment and to preclude excessive exposure of employees to such volatile solvents.

It is disclosed in U.S. Pat. No. specification 3,450,606 to partially anodize and color surfaces by first anodizing the whole surface and, if necessary, coloring it, after which parts of the anodized and, possibly, colored surface are partially masked, whereafter the anodized layer is etched from the non-masked parts and, subsequently, the surface is again immersed in an anodizing bath, whereby the etched parts are anodized in a second color. Also these anodized surfaces can be masked, partially etched and anodized in a different color. Repeatedly anodizing, masking, etching and re-anodizing is laborious and hence expensive.

U.S. Pat. No. specification 3,284,321 and German patent application 23 63 667 both describe the application of a resist onto the areas of a surface that are not to be anodized, after which the surface is anodized and, next, the resist is removed by immersing in a bath. Also in this case, the removal of the resist after the anodizing treatment is laborious. In addition, the initially masked surface region is not provided with a protective layer.

Japanese patent application 62-278277 describes a similar method of partially anodizing a surface, wherein, in addition, the surface is provided with a transparent protective film which covers the anodized and the non-anodized parts of the surface. The application of such a resist requires an additional operation and generally results in a not entirely satisfactory resistance to attack when an object coated with such a resist is intensively used.

SUMMARY OF THE INVENTION

It is an object of the invention to obtain, in a simpler manner, a wear and scratch-resistant protective layer which comprises at least two visually distinguishable types of surface areas.

In accordance with the invention, this object is achieved by using a method in which a sol-gel layer is provided as the mask layer, and forms the second surface area of the protective layer.

In this manner, as a result of masking, also the second surface area of the intended, highly wear and scratch-resistant protective layer is obtained. Consequently, to obtain the protection in the second surface area, an additional stripping treatment and/or electrochemical treatment is no longer necessary.

In addition, the sol-gel layer is substantially intact after electrochemical treatments, such as anodizing and, possibly, sealing, and also along the edges there is no substantial attack due to creep under the sol-gel layer. As a result, the support can be provided with a clear-cut, visually attractive pattern.

In the course of the electrochemical treatment, the sol-gel layer serves as an isolator, so that said electrochemical treatment is not effective in the masked area. This applies to treatments in which material is converted, such as an anodizing treatment, as well as to electroplating treatments in which material is deposited, such as zinc-plating, nickel-plating, chrome-plating and tin-plating.

Particularly advantage embodiments of the invention are described in the dependent claims.

BRIEF DESCRIPTION OF THE DRAWING

Further objects, aspects, effects, advantages and details of the invention become apparent from the following description of a few possible embodiments of the invention, wherein reference is made to the drawing.

DESCRIPTION OF THE EMBODIMENTS

The drawing is a flow chart of successive treatments and intermediate stages of an example of a method in accordance with the invention, comprising illustrations which depict a part of the housing of a shaver head of a shaver having rotary cutters in different stages of the treatment process.

The method shown in the drawing is a currently most preferred method of carrying out the invention to obtain an object with a surface having three distinguishable types of surface areas 1, 2, 3 and an uncoated engraved area 4. The areas 2 and 3 each consist of two portions, which are not interconnected, and which are indicated by means of the same reference numerals for the sake of simplicity.

First of all, a ball milling treatment 5 polished is carried out resulting in a polished state 6 which is illustrated in this example by a polished housing part 7 of the shaver.

Subsequently, the polished surface is lacquered (step 8) using a sol-gel, after which a state is obtained in this example which is illustrated by the housing part 10 of the shaver head. It is alternatively possible to apply a glossy sol-gel lacquer.

For more information about sol-gel layers and the application thereof, reference is made to international patent applications WO 98/22548 and WO 98/13434, the contents of which is included herein by reference, and which both relate to layers of the sol-gel type. The sol-gel layer may be formed, for example, from a polymeric material, for example on the basis of polysilicate, which is provided by means of a sol-gel process. The main chain or "backbone" of the sol-gel polymer comprises inorganic compounds; any side groups or side branches may be organic, if necessary.

The sol-gel layer can be obtained by applying a sol-gel substance directly onto the 7 which functions as a support and converting said sol-gel substance to the polymeric material.

The thickness of the sol-gel layer is preferably below 50 $\mu$m. In accordance with this example, the housing part 7 of the shaver head is made from an aluminium alloy. To obtain a good distribution and adhesion, it may further be advantageous to use organically modified silanes, such as aminopropyltrimethoxy silane (A1100).

The sol-gel layer of an inorganic polymeric material comprises, dependent upon the desired visual effect, fillers in the form of particles having certain visual properties, such as pigments and glittery particles.

Subsequently, the sol-gel layer is partially removed. In this example, the sol-gel layer is removed from first areas 2 of the surface of the housing part of the shaver head (step 11), after which a state 12 is obtained which is illustrated by the housing part 13 of the shaver head, the first areas 2 of which have bright aluminium surfaces, and the second area 1 is matt.

As, in the method in accordance with this example, the sol-gel layer is initially applied to an area which is larger than the second surface area 1, which eventually must be provided with a sol-gel layer, and, prior to anodizing, areas of the sol-gel layer are removed, the application of the sol-gel layer can be carried out very rapidly and without the risk of spattering and spilling. The removal of parts of the cured sol-gel layer is comparatively easy to control and can be carried out more accurately than the application of a sol-gel layer in accordance with a specific pattern using a wet process.

The removal of areas of the cured sol-gel layer is carried out, in this example, by processing using a laser beam. This has the advantage that it permits great freedom of design as regards the shape of the areas, that a high degree of accuracy can be attained, that the surface of the aluminium support is hardly subject to attack, and that the risk of damage is small.

Subsequently, the housing part of the shaver head is subjected to an electrochemical treatment which, in accordance with this example, consists of an anodizing treatment 14, which is preferably rounded off with a sealing treatment, in which anodizing treatment only the bright aluminium surface in the first areas 2 is anodized and a state 15 is obtained wherein a surface area of the housing part 16 of the shaver head is matt and the previously bright aluminium surface areas 2 are anodized. The rest of the surface area 1 of the housing part of the shaver head is masked by the sol-gel layer and, consequently, remains untreated. In this example, the first areas 2 are anodized so as to be bright. The two types of surface areas 1, 2 may differ from each other as regards brightness as well as shade and color. From the preceding description it is clear that the second surface area 1 is free from additional protective layers. The proposed method is now complete if two types of visually different surface areas are sufficient.

The thus obtained housing part 16 of the shaver head has an at least partly aluminum support with a surface provided with a protective layer having surface areas 2 of a first type whose protective layer is formed by an annealed outer layer, in this case a bright annealed outer layer, and a surface area 1 of a second type whose protective layer is a sol-gel layer. Dependent upon the way in which the sol-gel layer and the anodized layer are made, the surface areas 1, 2 may be distinguishable in that they differ from each other in one or more visual aspects, such as brightness, color and shade.

Just like an anodized layer and many other electrochemically treated surfaces, a sol-gel layer has a high resistance to wear and scratches and is resistant to many solvents, so that it can very suitably be used as a visually distinguishable protective layer in a surface area adjoining an anodized layer or another electrochemically formed layer. Therefore, the mask formed by a sol-gel layer can also be used as the ultimate protective layer in the masked area.

According to the method described by way of example, two types of different surface areas do not suffice, so that the housing part of the shaver head is provided with four types of different surface areas 1–4.

For this purpose, after the first anodizing operation 14, further areas 3 of the anodized layer in the first surface area 2 and of the sol-gel layer in the second surface area 1 are removed (step 17), also in this case by engraving using a laser beam, whereafter, in accordance with this example, a state 18 is obtained. The housing part 19 of the shaver head shown to illustrate this state is provided with laser-engraved, third, bright aluminium surface areas 3 which extend in both the area of the anodized layer and the area of the sol-gel layer. As the laser can remove parts of the anodized layer as well as parts of the sol-gel layer, one treatment for locally removing the sol-gel layer and the anodized layer is sufficient.

Also these third, bright aluminium surface areas 3 are subsequently protected and colored by subjecting the housing part of the shaver head to a second anodizing, coloring and sealing treatment 20. In this treatment, only the further areas 3 of the surface from which sol-gel material is removed by the anodizing treatment 20 undergo a substantial change of at least one visual property. Consequently, the third areas can be distinguished from the other two types of surface areas 1, 2 on the basis of, for example, color, shade and/or brightness. The treated housing part of the shaver head has then reached a state 21 wherein it exhibits colored indications, as illustrated by the housing part 22 of the shaver head.

As the first surface areas 2 are sealed after the first anodizing treatment 14, the second anodizing treatment 20 has very little influence on the visual properties of the surface areas 2 anodized during the first anodizing treatment 14.

Finally, a further laser-engraving operation 23 is carried out to bring the housing part of the shaver head in the state illustrated by the housing part 25 of the shaver head, in which state this housing part is provided with a text in the sol-gel layer.

From the foregoing, it will be clear to those skilled in the art that, within the scope of the invention, many alternative embodiments are possible, such as providing the sol-gel layer directly in accordance with a certain pattern, or applying the sol-gel layer in accordance with a rough pattern, after which only a limited quantity of the sol-gel material has to be removed to obtain a marking of the desired shape. Sol-gel material may also be removed in a different way, for example in combination with a material-removing operation to which parts of an object are subjected, such as turning a surface clean or milling it. It is also possible to employ a different electrochemical treatment, such as chrome-plating, tin-plating and the like.

#Glossary of Reference Signs:

5 ball milling
6 gloss
8 sol-gel lacquering
9 sol-gel
11 partially removed sol-gel
12 sol-gel+uncoated aluminium
14 anodize, seal
15 sol-gel+anodized layer
17 laser engraving
18 Sol-gel+anodized layer+uncoated aluminium
20 anodize, color, seal
21 Sol-gel+anodized layer+/−+anodized layer II
23 laser engraving
24 sol-gel+anodized layer I+anodized layer II+engraving

What is claimed is:

1. A method of forming a wear and scratch resistant protective layer on a surface of a support, wherein said surface comprises at least a first surface area (2) and a second surface area (1), which surface areas (1, 2) are distinguishable by virtue of the fact that said surface areas (1, 2) differ from each other in at least one visual property, which method comprises:

masking at least parts of said surface outside said first surface area (2) with a mask layer which covers at least all of said second surface area of the support, and subjecting said support to an electrochemical treatment (14, 20), wherein a protective layer is formed on non-masked parts of said support, characterized in that a sol-gel lacquer forming a wear and scratch resistant layer is provided as said mask layer, which forms a protective layer on said second surface area (1) of said surface, and said second surface area is free from additional protective layers.

2. A method as claimed in claim 1, wherein the second surface area (1) covered by the mask is determined by providing parts of said surface outside said second surface area (1) with the sol-gel lacquer layer while masking said at least parts of said surface, and by removing, prior to the electrochemical treatment (14, 20), parts of the sol-gel lacquer layer that are situated outside said second surface area (1).

3. A method as claimed in claim 2, wherein the removal (11) of parts of the sol-gel lacquer layer is carried out by means of a laser beam.

4. A method as claimed in claim 1, wherein said sol-gel lacquer is provided also on a further area (3) of said surface, after the electrochemical treatment (14), the sol-gel lacquer layer on said further area is removed, and said support is subjected to a further electrochemical treatment (20), wherein only said further area (3) from which the sol-gel lacquer layer is removed undergoes at least one substantial change of at least one visual property by subjecting said further area to said further electrochemical treatment (20).

5. A method as claimed in claim 1, characterized in that said sol-gel lacquer layer is formed from a polymeric material.

6. A method as claimed in claim 5, characterized in that said polymeric material has a main chain consisting of inorganic compounds.

7. A method as claimed in claim 5, characterized in that said sol-gel lacquer layer has a thickness less than 50 $\mu$m.

8. A method as claimed in claim 5, characterized in that said main chain is a polysilicate chain.

9. A method claimed in claim 8, characterized in that said polymeric material comprises organic side groups.

10. A method of forming a wear and scratch resistant protective layer on a surface of a support, wherein said surface comprises at least a first surface area (2) and a second surface area (1), which surface areas (1, 2) are distinguishable by virtue of the fact that said surface areas (1, 2) differ from each other in at least one visual property, which method comprises:

masking at least parts of said surface outside said first surface area (2) with a mask layer which covers at least all of said second surface area of the support, and subjecting said support to an anodizing treatment (14, 20), characterized in that a protective layer is formed on non-masked parts of said support, a sol-gel lacquer forming a wear and scratch resistant layer is provided as said mask layer, which forms a protective layer on said second surface area (1) of said surface, and said second surface area is free from additional protective layers.

11. A method as claimed in claim 10, wherein said surface is sealed after the anodizing treatment.

12. A method of forming a wear and scratch resistant layer on a surface of a support, wherein said surface comprises at least a first surface area (2) and a second surface area (1), which surface areas (1, 2) are distinguishable by virtue of the fact that said surface areas (1, 2) differ from each other in at least one visual property, which method comprises:

masking at least parts of said surface outside said first surface area (2) with a mask layer which covers at least all of said second surface area of the support, and subjecting said support to an electrochemical treatment (14, 20), whereby a protective layer is formed as an electrochemically treated area on non-masked parts of said support, characterized in that a sol-gel lacquer forming said wear and scratch resistant layer is provided as said mask layer, which forms a protective layer on at least said second surface area (1) of said surface, said second surface area thereby being covered with said sol-gel lacquer layer, and the method further comprises engraving (17) said surface in both said electrochemically treated first surface area (2) and said second surface area (1) covered with the sol-gel lacquer layer.

* * * * *